US005520347A

United States Patent [19]

Bass et al.

[11] Patent Number: 5,520,347

[45] Date of Patent: May 28, 1996

[54] ONE-PIECE REELEX PAYOUT TUBE

[75] Inventors: Benjamin A. Bass; John F. May, both of Omaha, Nebr.

[73] Assignee: AT&T Corp., Murray Hill, N.J.

[21] Appl. No.: 258,303

[22] Filed: Jun. 10, 1994

[51] Int. Cl.[6] ..... B65H 57/00; B65H 49/18; B65H 18/28

[52] U.S. Cl. ..... 242/157 R; 242/137.1; 242/163; 242/171

[58] Field of Search ..... 242/157 R, 137.1, 242/163, 171, 132, 140, 146, 170, 172

[56] References Cited

U.S. PATENT DOCUMENTS

| | | | |
|---|---|---|---|
| 2,796,225 | 6/1957 | Lenk | 242/157 R |
| 4,274,607 | 6/1981 | Priest | 242/171 X |
| 4,373,687 | 2/1983 | Zicko | 242/163 |
| 5,064,136 | 11/1991 | Hunt | 242/157 |
| 5,100,078 | 3/1992 | Clark | 242/130 X |
| 5,115,995 | 6/1992 | Hunt | 242/157 |
| 5,150,852 | 9/1992 | Hunt et al. | 242/157 |
| 5,152,476 | 10/1992 | Moser | 242/157 |

*Primary Examiner*—Michael R. Mansen

[57] ABSTRACT

A payout tube adapted to be secured to a container having wire or cable contained therein, has a flange at the entrance end thereof. The flange has a radiused surface wherein the radius is greater than the critical or kinking radius $R_c$, and a central opening where the radiused surface fairs into the inner wall of the tube, with the inner wall being substantially tangential to the radiused surface. A plurality of strengthening ribs are located on the underside of the flange and extend along the outer wall of the tube, with certain ones of the ribs intersecting other ribs at right angles thereto. Mounting mechanism located at the exit end of the tube also has strengthening ribs, with strengthening members intersecting the ribs at right angles thereto. Due to the configuration of the flange, tube, ribs and mounting mechanism, the payout tube can be formed or molded as one integral unit with a consequent reduction in production costs.

10 Claims, 3 Drawing Sheets

ONE-PIECE REELEX PAYOUT TUBE

FIELD OF INVENTION

This invention relates to arrangements for dispensing wire, cable, and the like from the containers in which it is coiled, and, more particularly, to a payout tube disposed within the container and communicating through a wall thereof to the exterior, through which the wire, cable, or the like is passed.

BACKGROUND OF THE INVENTION

It is the current practice to coil insulated communication wire in a figure 8 configuration within a box or carton for easy shipment and storage. The figure 8 configuration of the coil is used to reduce twisting of the wire as it is coiled, thereby reducing a tendency of the wire to kink as it is pulled from the carton, generally through an opening in a side wall thereof. The pulling process is facilitated by the installation of a payout tube which extends into the interior of the carton, and which is affixed to a wall thereof in a suitable manner so as to have a stub portion extending outside of the carton. In U.S. Pat. No. 5,152,476 of Moser, there is shown a preferred arrangement for affixing the tube to the wall of the carton having a modified bayonet lock type of action. Numerous prior art arrangements utilize this arrangement, or modifications thereof, for mounting the tube.

Most tubes in use today are in the form of hollow elongated cylinders with the ends thereof being radiused between the outer and inner walls to eliminate sharp corners over which the wire passes as it is pulled through the tube. Such radiused ends are shown in U.S. Pat. Nos. 5,064,136 and 5,115,995 of Hunt. In these arrangements, the entrance end surface substantially conforms to a hemi-toroidal surface having a faired joinder at its inner and outer margins with the inner and outer walls of the tube. Such a rounded surface imposes a lower limit on the bend radius of the wire being pulled through the tube, which however, does not prevent kinking of the wire or damage to its insulation when the wire is being pulled from layers immediately adjacent to the tube and lying between the end of the tube and the wall in which the tube is mounted. In that case, the wire undergoes a sharp reverse bend as it enters the tube, and the radiused end of the tube is insufficient to prevent kinking and possible damage.

The aforementioned Moser patent discloses an end cap for the entrance end of the payout tube which greatly increases the minimum possible radius of curvature of the wire, thereby materially reducing the tendency of the wire to kink even in the extreme reverse bend case discussed in the foregoing. The cap of the Moser patent has, at its entrance or back end an annular flange, the surface area of which conforms to approximately one quadrant of a toroidal surface having a radius of sufficient magnitude that when the wire is bent to pass over the surface in contact therewith, it will not kink. The toroidal surface of the cap is hired into a flat surface, the plane of which is substantially normal to the axis of the cap, and which borders the wire passage interior cylindrical wall surface of the cap. In use, the hollow cylindrical payout tube is mounted in the canon, and the cap is affixed to the entrance end, i.e., the interior or rear end. The wire being payed out cannot be bent to a radius less than the radius of the flange, even for a complete reverse bend, except where the wire passes into the payout tube. At the region where the cap joins the payout tube, there remains a relatively small radius surface over which the wire passes, which allows the wire to be bent to a radius that is too small to prevent kinking, i.e., the radius is less than the critical radius $R_c$ below which kinking can occur.

Any cap arrangement for the payout tube gives rise to the additional problem of the introduction of a separate pan, with the possibility of its being lost or mislaid. Also, the fabrication of such a separate pan requires additional molds and fabrication steps, thereby increasing the cost of the payout tube assembly. Moser apparently recognizes the problem, at least to some extent, by suggesting that the cap and the payout tube may be fused together to produce a single unitary structure, but apparently the two parts are intended to be fabricated separately and then joined, with a consequent two molding operations, hence, an increase in production costs..

BRIEF SUMMARY OF THE INVENTION

The present invention is a payout tube of molded plastic material such as a synthetic resin for use with coiled wire or cable contained in a carton, such as Reelex® cable. The tube is a single unitary structure having on its front or exit end a bayonet type mounting arrangement similar to that shown in the aforementioned Moser patent, for affixing the tube to the carton.

The rear or entrance end of the preferably cylindrical tube has formed thereon a circular flange member having an outer surface that conforms to approximately one-half of a toroid centered on the longitudinal axis of the tube. The inner opening of the flange is faired smoothly into the inner wall of the cylindrical bore of the tube, with no interruptions or sharp edges. The radius of curvature R of the toroidal surface is chosen to produce a surface over which the wire passes that at no time, even including the most severe reverse bend condition, is the wire bent to the critical bending radius $R_c$, below which the wire or cable tends to kink. In practice, it has been found that a surface radius of approximately 0.28 inch or more is sufficient, and a toroid outside diameter of approximately 1.71 to 1.75 inches is also adequate. Thus, the minimum radius to which the wire is bent on entering the payout tube is 0.28 inches, which is considerably greater than the critical radius of $R_c$. The payout tube may be, for example, approximately four inches (4") in overall length, with an inner bore diameter at the rear or entrance end of approximately 0.603 to 0.630 inches, with the only constraint being that the toroidal surface fairs smoothly into the interior wall of the tube. The transverse distance from the outer edge of the flange to the inner wall of the tube is, therefore, approximately 2R. Both the inner and outer diameter of the tube may taper outwardly from the rear or entrance end thereof to the front or exit end or the tube may be a fight cylinder or other suitable shape.

It is to be understood that these dimensions are suitable tier generally used communications wire or cable. Other types of wire or cable may necessitate other different dimensions, but the basic principles set forth herein remain the same. In all cases, the radius of curvature R of the flange surface exceeds the critical radius $R_c$ which will vary with the type of wire or cable, but which is readily determined for any type of wire or cable.

The flange is strengthened and supported by a plurality of ribs extending radially from the flat underside thereof along the outer wall of the tube for a suitable distance, a pair of ribs intersecting the radial ribs at right angles, and the flange has a plurality of spaced holes extending from the toroid surface for a distance into the body of the flange. The function of these holes, which are formed in the molding process, is to reduce the amount of material necessary to form the flange and tube, and to achieve an overall lighter structure, as well as reducing molding cycle time. The rib configuration likewise simplifies the molding process. In addition, the members forming the bayonet locking arrangement are braced by ribs which are oriented at right angles to each other for ease of molding.

The right angle orientation facilitates the molding process such as slip molding, thus making it possible to mold the entire tube in one operation.

Within the bore of the tube adjacent the region where the toroidal surface is faired into the inner wall of the tube bore is a diaphragm formed integrally therewith and comprising a plurality of radially extending flexible fingers which function to orient the wire or cable being pulled toward the center of the tube bore, yet which are flexible enough to yield to tension on the wire without damage thereto, or without causing kinking. The diaphragm also functions to prevent the wire or cable from snapping back into the canon when pulling tension is removed from the free or outer end.

These and other features of the present invention will be readily apparent from the following detailed description, read in conjunction with the accompanying drawings.

DETAILED DESCRIPTION

Figure 1:
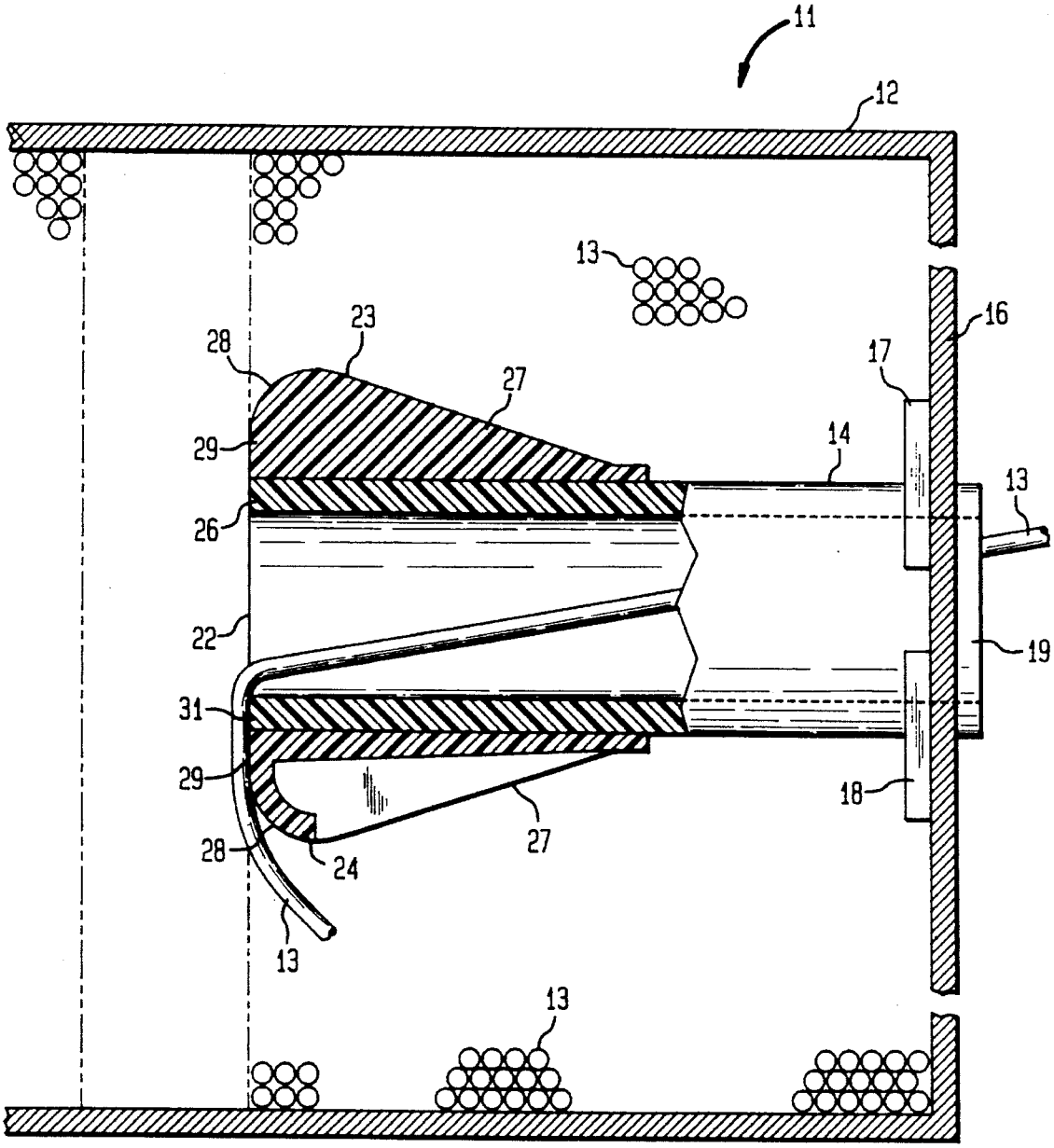
FIG. 1 (PRIOR ART)
FIG. 1 is a partial cross-section elevation view of a prior art payout arrangement.

In FIG. 1 there is shown the prior an payout tube arrangement 11 as embodied in the Moser patent. The arrangement 11 comprises a canon 12 of suitable material, such as corrugated cardboard, within which is the wire or cable 13, generally arranged in a stacked FIG. 8 configuration. A payout tube 14 is mounted in an aperture in one wall 16 of the canon 12 by means of stop lugs 17 and 18, and locking tabs 19 and 21, only tab 19 being shown, in the manner taught in the Moser patent. The inner, rear, or entrance end 22 of the tube 14 has a cap 23 mounted thereon, with a curved flange 24 extending radially outward from the interior bore 26 of the cap. The flange 24 is supported by radial ribs 27, 27 and has an outer surface 28 which conforms to the surface of a toroid having a radius greater than the aforementioned critical radius $R_c$, which fairs into a flat surface 29 which is co-planar with the inner end 31 of the tube 14. End 31 is radiused, as taught in the prior art, to reduce possible damage to the wire from sharp edges, but this radius is substantially less than the critical radius $R_c$. As can be seen in FIG. 1, when the wire or cable 13 is pulled from the carton through tube 14, as pulling tension is increased, the wire contacts the flange 24 and surface 29, and thus cannot be bent to a radius less than the radius of the surface 28 of the flange 24. Thus, there is no tendency of the wire to kink. However, under tension, the wire can be bent to a radius that is less than $R_c$ as it enters tube 14, as shown, and is thereby no longer prevented from kinking.

The present invention, as depicted in FIGS. 2 through 7, insures that there will be substantially no kinking of the wire as it is pulled from the carton, regardless of the pulling tension applied thereto.

Figure 2:
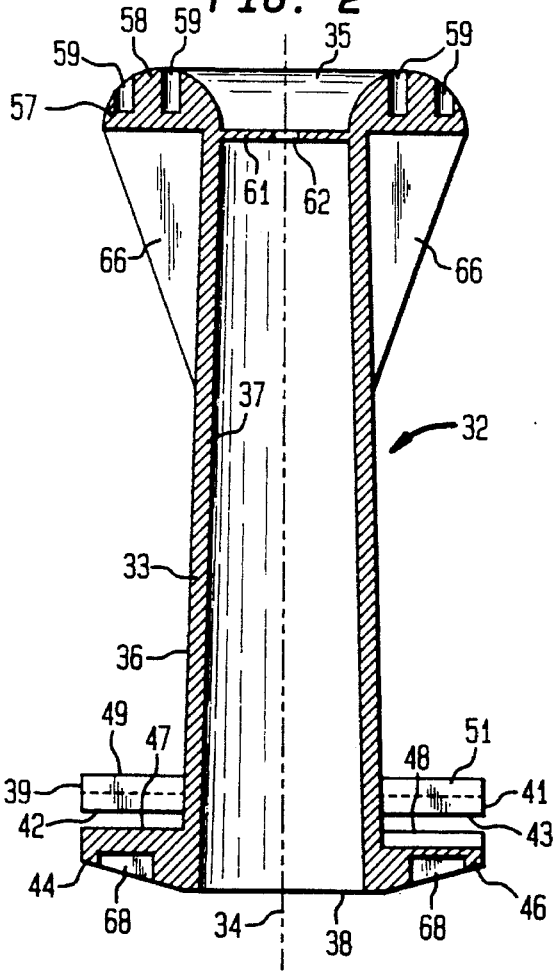
FIG. 2 is a cross-section elevation view of the payout tube of the invention.
Figure 3:
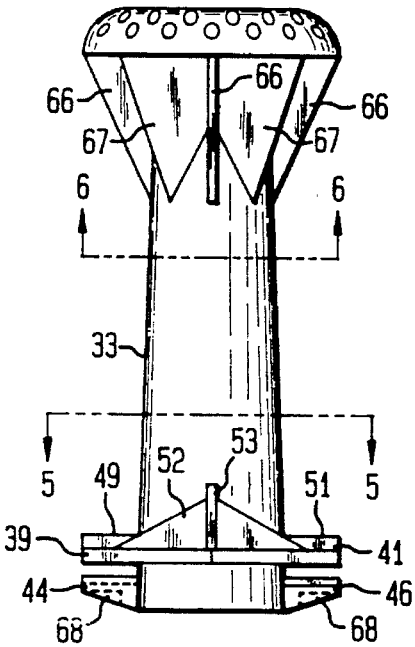
FIG. 3 is an elevation view of the payout tube of the invention.

FIG. 2 is a cross-sectional elevation view of the payout tube 32 of the present invention which comprises an elongated tubular body 33 having a central axis 34 and which is preferably of a molded synthetic resinous material. Tubular body 33 can be a right cylinder or other shape, depending in part on the material of the tube 32 or on the molding process used. In FIG. 2 it is shown as a hollow frusto-conical body having a tapering outer wall 36 and inner wall 37 which taper outwardly from the rear or entrance end 35 to the front or exit end 38 of the payout tube 32. The exit end 38 has first and second stop lugs 39 and 41 having beating surfaces 42 and 43 respectively which are adapted to bear against the interior of the carton wall through which the end of the tube passes. Locking tabs 44 and 46 extend from tubular body 33 and have bearing surfaces 47 and 48 respectively which are spaced from surfaces 42 and 43 a distance that is slightly less than the wall thickness of the canon to which the tube 32 is to be mounted. Although it is not shown, surfaces 47 and 48 have a curved portion, as taught in the Moser patent, to facilitate locking tube 32 in place on the canon. As will be discussed more fully hereinafter, stop lugs 39 and 41 are strengthened by ribs 49 and 51 and ribs 52 and 53, which are more clearly seen in FIG. 5. When the exit end 38 of tube 32 is passed through the hole 54 (FIG. 7) in the wall 56 of the carton, in the manner taught by Moser, and then rotated to lock it in place, the lugs 42 and 43 and tabs 44 and 46 are subjected to considerable stress. The strengthening ribs insure that the lugs and tabs can withstand this stress, thereby reducing the possibility of breakage during installation and during use.

At the entrance end 35 of tube 32 is a flange member 57 having the shape of one-half of a toroid centered on the axis 34. The semi-circular surface 58 of the flange 57 extends from the outer edge of the flange to inner wall 37 and is integral therewith. The radius of curvature $R_1$ of surface 58 is governed by the outer diameter of the flange 57 and the inside diameter of wall 37 at the entrance end 35, and is so chosen that the surface 58 fairs smoothly into wall 37, with no discontinuities or protuberances. Put another way, the surface of wall 37 is tangent to the radius of surface 58. In any case, it is necessary that the radius $R_1$ of surface 58 be substantially greater than the critical bending radius $R_c$. As a consequence, the wire being paid out cannot be bent to a radius less than $R_1$, as the wire passes into the entrance end 35 of the tube, regardless of the pulling tension applied thereto. In practice, for Reelex® types of cable or wire, it has been found that the radius of the surface 58 can be approximately 0.58 inches for a flange outside diameter of approximately 1.75 inches and an inside wall diameter at the entrance end of approximately 0.603 to 0.620 inches. These dimensions may vary to some extent, but in every case surface 58 fairs smoothly into wall 37. It can be appreciated that the dimensions given are for one generalized group of cables. Other types of wire or cable may require different dimensions for the payout tube but the principles of the invention still apply to the design and configuration of the tube.

Figure 4:
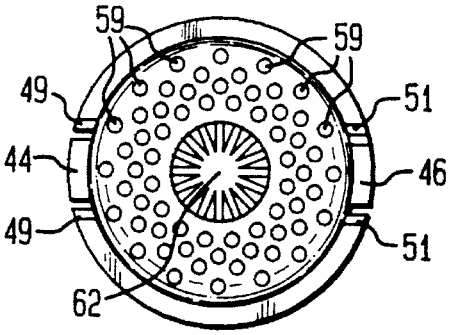
FIG. 4 is a plan view of the entrance end of the payout tube of FIGS. 2 and 3.

Flange 57 has a plurality of spaced holes 59, 59 formed therein which extend from surface 58 into the semi-circular body for a substantial distance and which are preferably arranged in concentric circles, as best seen in FIG. 4. These holes serve to lighten the tube 32 somewhat, and also reduce the amount of material used in the molding process. Although such a reduction in material might result in only a slight saving in cost per unit, in view of the extremely large number of units manufactured the overall saving is considerable.

At the entrance end 35, in the region where surface 58 and interior wall 37 are faired together, is a diaphragm 61 which is formed integrally with wall 37 in the molding process. Diaphragm 61 has a central opening 62 which is preferably slightly smaller than the diameter of the wire or cable being paid out. Opening 62 is at the center of a "star" configuration of the diaphragm formed by a plurality of radially extending slits 63, 63 spaced at equal angles to each other, thereby dividing the area of diaphragm 61 into a plurality of wedge shaped fingers 64, 64. The width of each slit 63 is considerably less than the diameter of the wire being pulled. The thickness of diaphragm 61 is so chosen that the fingers 64, 64 are resilient and yield readily to the wire under pulling tension. On the other hand, the diaphragm 61, opening 62, and fingers 64 tend to center the wire and to hold it in place when it is not under tension. In addition, when the wire is under tension and is cut, it tends to spring back into the carton, but such springing back is prevented by diaphragm 61. In practice, it has been found that a diaphragm thickness of from 0.01 to 0.15 inches imparts the desired resiliency to fingers 64, 64 without derogating from the centering and "anti-springback" functions.

Figure 5:
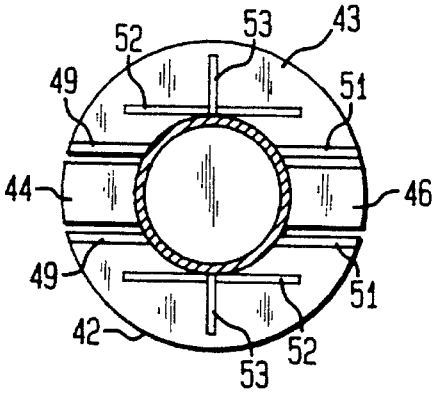
FIG. 5 is a view along the line 5—5 of FIG. 3.
Figure 6:
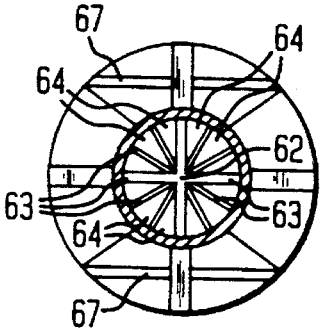
FIG. 6 is a view along the line 6—6 of FIG. 3.
Figure 7:
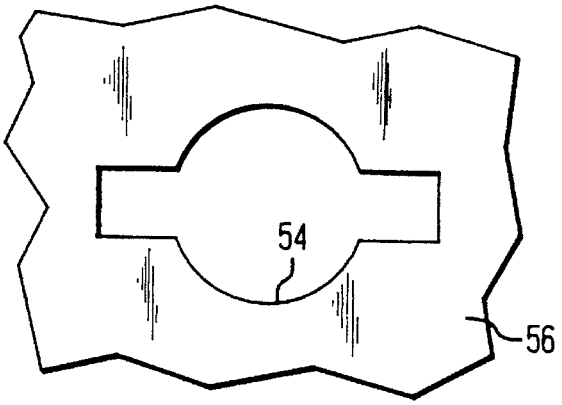
FIG. 7 is a partial view of the wall of the wire containing carton as apertured to receive the payout tube of FIGS. 2 and 3.

Flange 57 has, extending from the underside thereof, strengthening support ribs 66, 66 which extend radially outward from the tube body 33 and longitudinally along a portion of its length, as shown in FIG. 2. Additional support ribs 67, 67 extend at right angles to the ribs 66 from equally spaced chords on the circular underside of flange 57, as best seen in FIG. 6. Ribs 67, 67 are intregral with the tube body 33 and with ribs 66, 66. This unique configuration of ribs insure sufficient support and strength for flange 57, and also materially simplifies the slip molding process so that separate molding operations are not necessary. This right angle orientation of support and strengthening ribs is likewise used for the ribs at the exit end of tube 32 which strengthen the stop lugs 42 and 43. As best seen in FIG. 5, radially extending ribs 53, 53 are each intersected at right angles by the ribs 52 both of which lies upon a chord of the circle defined by the periphery of the stop lugs. Locking tabs 44 and 46 are also strengthened by the ribs 68, 68. The ribs 49, 49 and 51, 51, which are located on the stop lugs 42 and 43 and extend along the edges of the gaps formed between lugs 42 and 43, as best seen in FIG. 5, also impart additional strengthening to the payout lock assembly, more specifically to the edges of the stop lugs 42 and 43 and extend along the edges of the gaps formed between lugs 42 and 43, as best seen in FIG. 5, also impart additional strengthening to the bayonet lock assembly, more specifically to the edges of the stop lugs 42 and 43.

The foregoing description of a preferred embodiment of the invention is illustrative of the principles and features thereof. Numerous variations, changes, or modifications may occur to workers skilled in the art without departure from the spirit and scope of the invention.

We claim:

1. A payout tube for use with a container having wire or cable therein, for guiding the wire or cable from the interior of the container to the exterior thereof, the container having an aperture therein for receiving the payout tube, said payout tube comprising:

a tubular body composed of a molded plastic material, having an exterior wall and an interior wall defining a passage for the wire or cable, said tubular body having a central axis and an entrance end and an exit end;

mounting means on said tubular body adjacent said exit end thereof, said mounting means composed of the molded plastic material and formed integrally with said tubular body for mounting said tubular body in the aperture in the container and affixing it to a wall of the container;

a flange member at said entrance end of said tubular body, said flange member composed of the molded plastic material and formed integrally with said tubular body, said flange member having a greater transverse dimension than the transverse dimension of said tubular body thereby having a peripheral edge spaced from said interior wall of said tubular body by a predetermined distance;

said flange member further having a curved surface having a radius of curvature $R_1$ that is greater than the critical bending radius $R_c$ of the wire or cable;

the diameter of the flange and the radius $R_1$ being so chosen that the distance from said peripheral edge of said flange to said inner wall of said tubular body is approximately equal to $2R_1$; and said curved surface of said flange member being faired smoothly into said inner wall;

wherein said mounting means comprises first and second stop lugs extending radially outward from said outer wall and spaced from each other by first and second gaps, locking tabs longitudinally spaced from said stop lugs and overlying said first and second gaps, and first strengthening ribs extending from said stop lugs along a portion of the length of said outer wall.

2. A payout tube as claimed in claim 1 wherein the surface of said inner wall is tangent to said curved surface.

3. A payout tube as claimed in claim 1 wherein said flange member has a body formed as one-half of a toroid centered on said central axis.

4. A payout tube as claimed in claim 3 wherein said body has a plurality of holes extending into said body from said curved surface of said flange member.

5. A payout tube as claimed in claim 1 and further comprising wire or cable centering means within said passage extending transversely of said passage from said interior wall toward said central axis.

6. A payout tube as claimed in claim 5 wherein said centering means comprises a diaphragm having a central opening and a plurality of resilient fingers extending from said inner wall toward said central opening.

7. A payout tube as claimed in claim 1 wherein said flange member has a substantially flat undersurface, and further comprising first strengthening ribs composed of molded plastic material and formed integrally with said flange member and tubular body, extending from said undersurface and along a portion of said outer wall.

8. A payout tube as claimed in claim 7 and further comprising second strengthening ribs composed of molded plastic material and formed integrally with said flange member and tubular body, oriented at right angles to at least one of said first ribs and extending from said undersurface along at least a portion of said outer wall.

9. A payout tube as claimed in claim 8 wherein said flange member is circular and said second ribs are located along chords of the circle offset from said central axis.

10. A payout tube as claimed in claim 1 and further comprising second strengthening ribs each intersecting a first strengthening rib at right angles thereto.

* * * * *